US009080360B2

(12) United States Patent
Joray

(10) Patent No.: US 9,080,360 B2
(45) Date of Patent: Jul. 14, 2015

(54) SEMI-HIDDEN FRAMING FOR PANELS

(71) Applicant: Orchidees Constructions S.A., Onnens (CH)

(72) Inventor: Eric Joray, St-Aubin (CH)

(73) Assignee: Orchidees Constructions S.A., Onnens (CH)

( * ) Notice: Subject to any disclaimer, the term of this patent is extended or adjusted under 35 U.S.C. 154(b) by 0 days.

(21) Appl. No.: 14/074,354

(22) Filed: Nov. 7, 2013

(65) Prior Publication Data

US 2014/0059938 A1 Mar. 6, 2014

Related U.S. Application Data

(63) Continuation of application No. 13/136,941, filed on Aug. 15, 2011, now Pat. No. 8,578,668.

(30) Foreign Application Priority Data

May 20, 2011 (EP) ..... 11166993

(51) Int. Cl.
*E06B 1/04* (2006.01)
*E05D 15/06* (2006.01)
(Continued)

(52) U.S. Cl.
CPC ..... *E05D 15/0691* (2013.01); *E05D 15/0665* (2013.01); *E05D 15/0678* (2013.01);
(Continued)

(58) Field of Classification Search
CPC ..... E05D 15/0613; E05D 15/0665; E05D 15/0678; E05D 15/0682; E05D 15/0686; E06B 3/46; E06B 3/4609; E06B 3/24
USPC ..... 52/204.1, 205, 207, 210, 204.5, 204.51, 52/204.53, 204.595, 204.6, 204.71
See application file for complete search history.

(56) References Cited

U.S. PATENT DOCUMENTS 1,731,801 A 10/1929 Tracy
3,072,975 A * 1/1963 Burmeister ..... 49/317
(Continued)

FOREIGN PATENT DOCUMENTS

EP 2 093 364 A1 8/2009
EP 2199482 A2 * 6/2010 ..... E04B 2/82
(Continued)

*Primary Examiner* — Mark Wendell
*Assistant Examiner* — Keith Minter
(74) *Attorney, Agent, or Firm* — Kriag DeVault LLP

(57) ABSTRACT

The invention relates to a semi-hidden framing for panels (5) sliding in an opening (3) defining an outer surface ($S_e$), in particular for windows and French windows, arranged to hold at least one panel (5) comprising a fixed frame (1) and an intermediate element (4) intended to be fixed to the said panel (5) and cooperating with displacement means (2) associated with the said fixed frame (1) so as to permit the displacement of the said panel (5) along the said fixed frame (1), wherein the opening (3) comprises at least one through slot (6*a*, 6*b*), and wherein the said intermediate element (4) comprises at least one main longitudinal wing (4*a*, 4*b*) passing through the said at least one through slot (6*a*, 6*b*), and at least one longitudinal pad (4*d*, 4*e*) connected to one of the ends of the said at least one main longitudinal wing (4*a*, 4*b*) and intended to cooperate with the displacement means (2), the said fixed frame (1) being positioned entirely above or below the outer surface ($S_e$) so that the fixed frame does not disclose any element protruding to the outside of the opening (3).

13 Claims, 4 Drawing Sheets

(51) Int. Cl.
*E06B 1/36* (2006.01)
*E06B 3/46* (2006.01)

(52) U.S. Cl.
CPC ..... *E05D15/0682* (2013.01); *E05D 15/0686* (2013.01); *E06B 1/36* (2013.01); *E06B 3/4609* (2013.01); *E05D 15/0613* (2013.01); *E05Y 2900/148* (2013.01)

(56) References Cited

U.S. PATENT DOCUMENTS 3,423,897 A * 1/1969 Birum, Jr. ..... 52/773
4,462,192 A * 7/1984 Fisher ..... 52/240
4,619,095 A * 10/1986 Johnston ..... 52/592.3
4,823,511 A * 4/1989 Herliczek et al. ..... 49/404
4,912,807 A 4/1990 Futch et al.
5,678,366 A * 10/1997 Nambo et al. ..... 52/207
6,082,050 A * 7/2000 Schilling ..... 49/505
6,209,171 B1 * 4/2001 Pelletier et al. ..... 16/97
6,393,780 B1 * 5/2002 Jung ..... 52/211
6,526,625 B2 * 3/2003 Becken ..... 16/105
7,588,653 B2 * 9/2009 Crandell et al. ..... 156/109
7,770,329 B2 * 8/2010 Hutnik et al. ..... 49/425
8,584,317 B2 * 11/2013 Liebscher et al. ..... 16/91
2007/0186494 A1 * 8/2007 Hancock ..... 52/204.51
2007/0234657 A1 * 10/2007 Speyer et al. ..... 52/207
2008/0078068 A1 * 4/2008 Cervantes ..... 16/96 R
2010/0205880 A1 * 8/2010 Lin ..... 52/207
2011/0126471 A1 * 6/2011 Hans ..... 49/409
2012/0317899 A1 * 12/2012 Von Hoyningen Huene et al. ..... 52/167.1

FOREIGN PATENT DOCUMENTS

EP 2 221 440 A1 8/2010
WO 2010130837 A1 11/2010

* cited by examiner

SEMI-HIDDEN FRAMING FOR PANELS

TECHNICAL FIELD

The present invention relates to a semi-hidden framing for panels sliding in an opening in particular for windows and French windows, arranged to hold at least one panel.

The present invention aims to propose a semi-hidden framing such that the different constituent elements of the fixed frame are entirely positioned above or below the outer surface of the opening so that the fixed frame does not disclose any element protruding to the outside of the opening.

STATE OF THE ART

In traditional framings for panels sliding in an opening, the longitudinal profiled parts of the fixed frame are positioned, at least partially, protruding from the opening so as to embrace the panel. It is known to use various devices associated with the said fixed frame so as to provide a sliding support for the panel. European patent application EP 2 221 440 A1 details and claims a framing of this type and a sliding support of this type while the application EP 2 093 364 A1 details and claims another type of sliding support.

The elements of the framing, in particular the fixed frame, which are positioned outside of the opening form protrusions with respect to the floor or to the ceiling and have various disadvantages from an aesthetic and functional point of view. Firstly, such elements interrupt the planes formed by the floors and the ceilings. This type of framing thus does not achieve an impression of continuity and unity in floors and ceilings. The aesthetic effect of the building is thus impaired. The said elements protruding from the opening also have a major disadvantage in terms of a risk of tripping and injury for a person moving between the spaces separated by the opening. Furthermore, these protruding elements constitute obstacles which are difficult to negotiate for people moving in a wheelchair or using a walking aid. Furthermore, the movement of objects, whether or not they are mounted on wheels, can prove difficult owing to these protruding elements. This could relate in particular to the movement of furniture, in particular chairs, deckchairs, armchairs and tables, as well as parasols, barbecues, pot plants or any other decorative object.

The aim of the present invention is thus to provide a solution to the above-mentioned problems.

DISCLOSURE OF THE INVENTION

To this end, the present invention concerns a framing for panels sliding in an opening defining an outer surface, in particular for windows and French windows, arranged to hold at least one panel and comprising a fixed frame and an intermediate element intended to be fixed to the said panel and cooperating with displacement means associated with the said fixed frame so as to permit the displacement of the said panel along the said fixed frame, wherein the opening comprises at least one through slot, and wherein the said intermediate element comprises at least one main longitudinal wing passing through the said at least one through slot, and at least one longitudinal pad connected to one of the ends of the said at least one main longitudinal wing and intended to cooperate with the displacement means, the said fixed frame being positioned entirely above or below the outer surface so that the fixed frame does not disclose any element protruding to the outside of the opening. Other possible configurations of the invention are defined in the dependent claims.

The invention thus configured provides a framing in which the different constituent elements of the fixed frame are entirely positioned above or below the outer surface of the opening so that the fixed frame does not disclose any element protruding to the outside of the opening. Consequently the use of such a device provides an impression of continuity and unity in the floors and ceilings between the spaces separated by the opening. The aesthetics of the location are thus not impaired by the presence of constituent elements of the fixed frame. The absence of elements protruding from the opening means that the ease of movement between the spaces separated by the opening is not hampered. The risks of tripping and injury are avoided. Access to the spaces separated by the opening for people with reduced mobility or who are handicapped, as well as the movement of objects between the said spaces, is also facilitated thereby.

BRIEF DESCRIPTION OF THE DRAWINGS

Other advantages and features of the present invention will be better understood upon reading about particular embodiments of the invention and with reference to the drawings in which.

DETAILED DESCRIPTION OF THE EMBODIMENTS OF THE INVENTION

The invention is described with reference to FIGS. 1 to 4 which show, as an example, two embodiments of the invention adapted to hold a double glazing unit. These exemplified applications are in no way limiting of the present invention. Moreover, the device of the invention can be applied to other types of panels.

Figure 1:
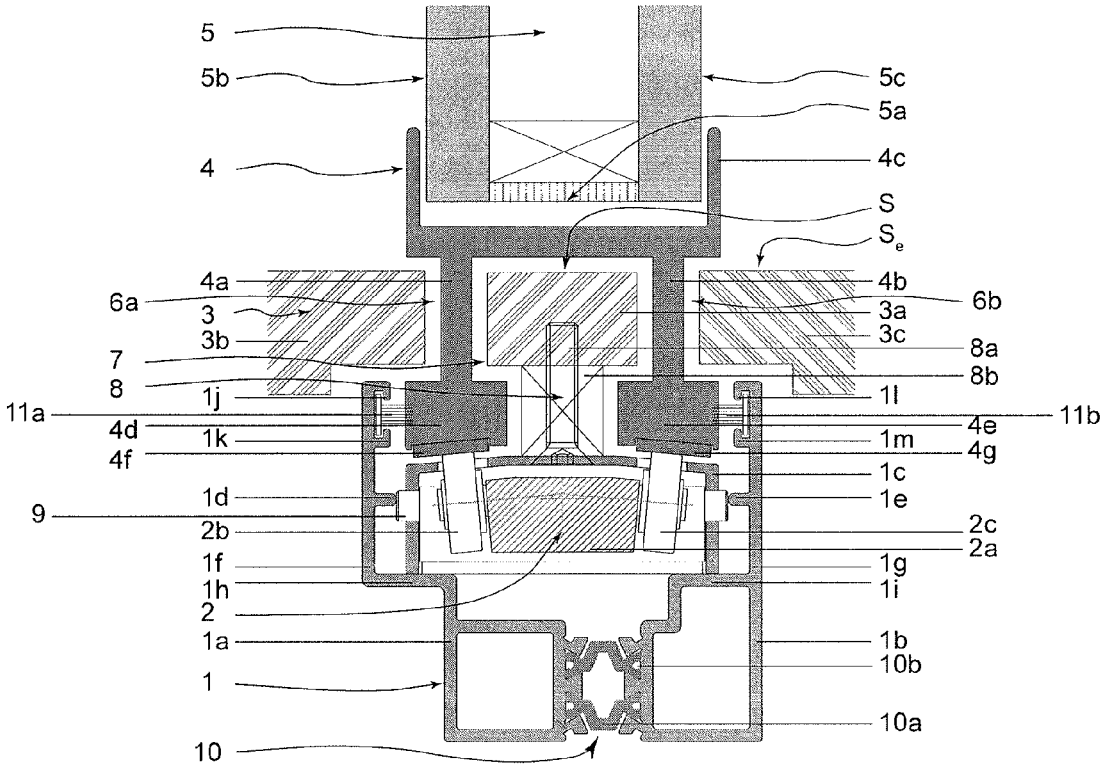
FIG. 1 is a cross-sectional view in a vertical plane of the lower part of a framing in accordance with the invention in a first embodiment.

FIG. 1 is a cross-sectional view in a vertical plane of the lower part of a framing in accordance with the invention in a first embodiment. The framing arranged to hold a panel 5, in this case formed by a double glazing unit, comprises an intermediate element 4, a fixed frame 1 and displacement means 2 associated with the fixed frame 1 permitting displacement of the panel 5 along the fixed frame 1. The intermediate element 4 is intended to be fixed to the said panel 5. In order to do this, the intermediate element 4 comprises a profile 4*c*, for example a U-shaped profile capping the panel 5 on one of its longitudinal edges 5*a*, the intermediate element 4 and the panel 5 being fixedly attached to each other by gluing at least one face 5*b* and 5*c* of the panel 5 to at least one longitudinal wing of the U-shaped profile 4*c*. Various geometries for the profile 4*c*, such as an L-shaped or O-shaped profile or a planar or quasi-planar longitudinal profile, can be used in place of a U-shaped profile by adapting the connection means between the profile 4*c* and the panel 5. While gluing between the profile 4*c* and the panel 5 can be carried out at various positions, other connection means, such as nuts and bolts or welding, can replace or be used together with the said gluing. The intermediate element 4 comprises two main longitudinal wings 4*a* and 4*b* connected at one of their ends to the profile 4*c*, and two longitudinal pads 4*d* and 4*e* connected to the other end of the main longitudinal wings 4*a* and 4*b*. The opening 3 of the framing comprises two through slots 6*a* and 6*b* defining two lateral opening elements 3*b* and 3*c* and at least one intermediate opening element 3*a* disposed between the through slots 6*a* and 6*b*. A through slot is understood to be a slot opening through both sides of the opening 3. The through slots 6*a* and 6*b* are less than 15 mm wide, preferably equal to 10 mm wide, while their cross-section is preferably rectangular. The main longitudinal wings 4*a* and 4*b* respectively pass through the through slots 6*a* and 6*b* so that the profile 4*c* is entirely positioned outside the opening 3, i.e. above the upper surface $S_e$ of the lateral opening elements 3*b* and 3*c*. This surface $S_e$ can advantageously be aligned with the floor of the building inside which the framing is disposed. In a similar manner, in the case of the upper part of the framing, this surface $S_e$ will advantageously be aligned with the ceiling of the building inside which the framing is disposed, the configuration of the framing thus being symmetrical with respect to a horizontal plane to the configuration shown in FIG. 1. The main longitudinal wings 4*a* and 4*b* are preferably transversely centered in the through slots 6*a* and 6*b* and the width of the main longitudinal wings 4*a* and 4*b* is dimensioned so that the transverse distance between these and the opening 3 is less than 5 mm. The longitudinal pads 4*d* and 4*e* are provided with support strips 4*f* and 4*g* disposed longitudinally. The support strips 4*f* and 4*g*, preferably of stainless steel, cooperate with the displacement means 2 which comprise bearing slide support units 2*a* each comprising two ball bearings 2*b* and 2*c* rolling on the support strips 4*f* and 4*g*. Consequently the intermediate element 4, in cooperation with the displacement means 2 associated with the fixed frame 1, allows longitudinal displacement of the panel 5 along the fixed frame 1. The ball bearings 2*b* and 2*c*, preferably of the same dimension, are mounted on fixed axes inclined in opposite directions by a small angle with respect to the horizontal so as to ensure self-centering of the panel 5 as it slides. The displacement means 2 will be explained in more detail hereinunder in the description of FIG. 2. The main longitudinal wings 4*a* and 4*b* define a longitudinal channel 7 in the intermediate element 4 in which the intermediate opening element 3*a* is engaged. The intermediate opening element 3*a* can be held in the longitudinal channel 7 by various connection means linked to the fixed frame 1. In FIG. 1, the fixed frame 1 comprises a covering profiled part 1*c* in an inverted U shape placed on two seats 1*h* and 1*i* of the longitudinal profiled parts 1*a* and 1*b* respectively which form the fixed frame 1. The seats 1*h* and 1*i* are preferably coplanar. With the help of connection means 8 comprising at least one bolt 8*a* and optionally a strut 8*b*, the intermediate opening element 3*a* is fixed on the covering profiled part 1*c* and held in the longitudinal channel 7. The intermediate opening element 3*a* is preferably transversely centered in the longitudinal channel 7 and the width of the intermediate opening element 3*a* is such that the transverse distance between this intermediate opening element and the main longitudinal wings 4*a* and 4*b* is less than 5 mm. The transverse distance between the main longitudinal wings 4*a* and 4*b*, i.e. the width of the longitudinal channel 7, and a fortiori the width of the intermediate opening element 3*a* depend on the width of the panel 5. In a double glazing unit panel the distance between the two main longitudinal wings 4*a* and 4*b* is typically of the order of 35 mm. The intermediate opening element 3*a* is preferably dimensioned and positioned so that its upper surface S is at the level of the upper surface $S_e$ of the lateral opening elements 3*b* and 3*c*.

The fixed frame 1, formed from longitudinal profiled parts 1*a* and 1*b*, and the intermediate element 4 are preferably made from aluminum or another light alloy, where appropriate from synthetic material. The longitudinal profiled parts 1*a* and 1*b* are assembled with the help of connection means 10. For example, the connection means 10 comprise at least one connecting strip 10*a* engaged in at least one slot 10*b* formed in the lateral edges of the longitudinal profiled parts 1*a* and 1*b*. The connection means 10 preferably comprise two connecting strips 10*a* each engaged in a different slot 10*b*. The longitudinal profiled parts 1*a* and 1*b* respectively comprise a longitudinal wing 1*f* and 1*g* with, in their upper part, a pair of re-entrant edges 1*j*, 1*k* and 1*l*, 1*m* which respectively hold brushes 11*a* and 11*b* in contact with the intermediate element 4 and, in their centre part, an internal longitudinal rib 1*d* and 1*e*. The displacement means 2 are fixedly attached to the covering profiled part 1*c* by means of transverse pins 9 disposed between internal longitudinal ribs 1*d* and 1*e* and dimensioned according to the width of these internal longitudinal ribs 1*d* and 1*e*.

Owing to the framing being configured in this way, the panel 5 is disposed so as to slide longitudinally, i.e. in the plane perpendicular to the plane of FIG. 1, in the fixed frame 1. In the open position, the framing does not disclose any element protruding to the outside of the opening 3, the various constituent elements of the fixed frame 1 being positioned entirely within this opening, i.e. below the surfaces S and $S_e$ of the opening elements 3*a*, 3*b* and 3*c* for the lower part of the framing and above the surfaces S and $S_e$ of the opening elements 3*a*, 3*b* and 3*c* for the upper part of the framing. Both from an aesthetic and functional point of view, the stated disadvantages of the traditional framings are avoided.

Figure 2:
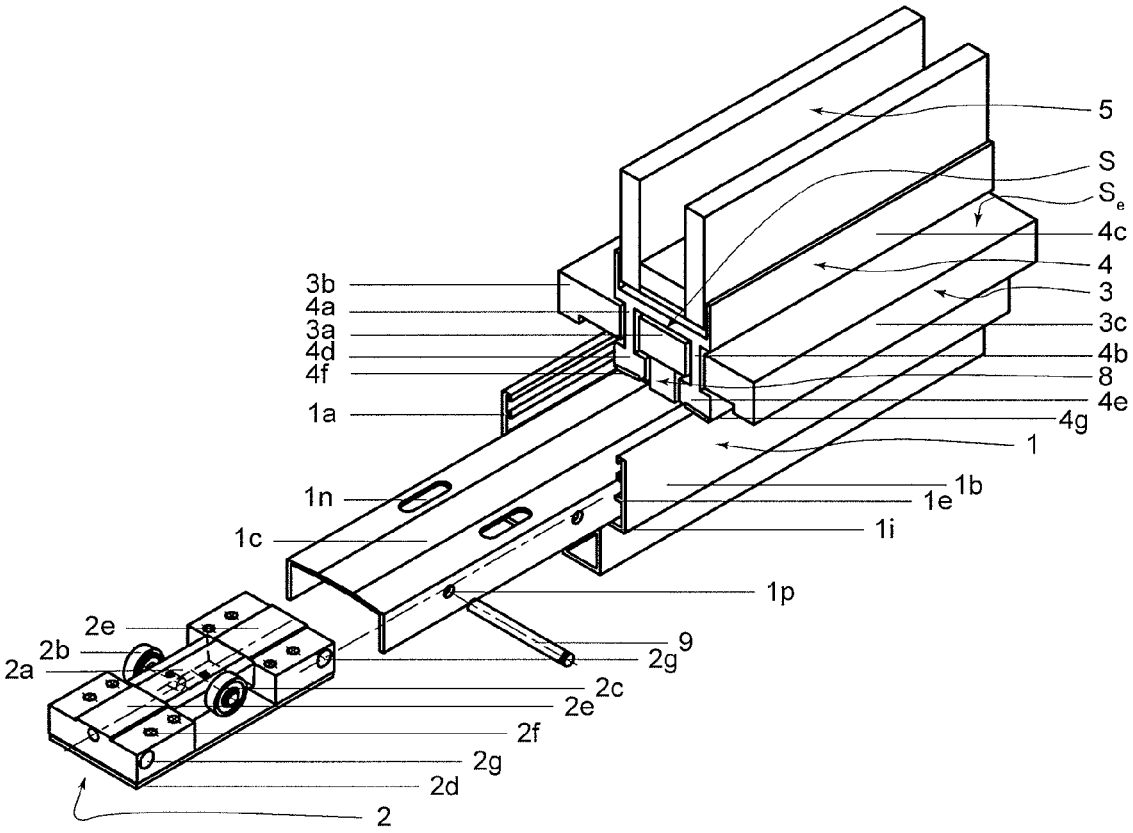
FIG. 2 is an axonometric exploded perspective view of the lower part of the framing in accordance with FIG. 1.

FIG. 2 is an axonometric exploded perspective view of the lower part of the framing of FIG. 1. This view of the framing contains the same elements as in FIG. 1 which means that it is not necessary to list them again. The description of FIG. 2 will concentrate hereinunder on the displacement means 2 and their interactions with different elements of the framing. European patent application EP 2 093 364 A1, filed by the Applicant, details and claims such displacement means.

As stated above, the fixed frame 1 comprises a covering profiled part 1*c* in an inverted U shape placed on two seats 1*h* and 1*i* of the longitudinal profiled parts 1*a* and 1*b* respectively. The seats 1*h* and 1*i* are preferably coplanar. Below the inverted U-shaped profiled part 1*c*, displacement means 2 are placed on the seats 1*h* and 1*i* and positioned at intervals. In addition to carrying out the function of concealing and protecting the displacement means 2, the profiled part 1*c* can serve, as mentioned above, to hold with the help of connection means 8 the intermediate opening element 3*a* in the longitudinal channel 7 defined by the main longitudinal wings 4*a* and 4*b*. Each displacement means unit 2 comprises a rectangular base plate 2*d*, two suspension blocks 2*e* mounted at the ends of the rectangular base plate 2*d*, and a bearing slide support unit 2*a*. The bearing slide support units 2*a* each comprise two ball bearings 2*b* and 2*c*, preferably of the same dimension. The ball bearings 2*b* and 2*c* are mounted on fixed axes inclined in opposite directions by a small angle with respect to the horizontal so as to ensure self-centering of the panel 5 as it slides. The covering profiled part 1*c* comprises elongate openings 1*n* at intervals on its horizontal or quasi-horizontal face, and bores 1*p* on its vertical or quasi-vertical faces. The elongate openings 1*n* are placed so as to permit the ball bearings 2*b* and 2*c* to cooperate with the intermediate element 4, in particular with the longitudinal pads 4*d* and 4*e* respectively provided with support strips 4*f* and 4*g*. The displacement means 2 are fixed along the longitudinal profiled parts 1*a* and 1*b* with the help of pins 9 introduced into the bores 1*p*. In fact a transverse pin 9, dimensioned so as to be wedged between the inner longitudinal ribs 1*d* and 1*e* of each longitudinal profiled part 1*a* and 1*b* passes transversely through the bores 1*p* of the profiled parts 1*c* as well as each suspension block 2*e* owing to the presence of bores 2*g* in this block. The number and positioning of the said elongate openings 1*n* and bores 1*p* are appropriate to the dimensions and number of the displacement means 2 used in the framing. Each suspension block 2*e* comprises four bores 2*f* perpendicular to the base plate 2*d* and partially threaded. A bolt and a spring are engaged in each of the bores 2*f* and connect the suspension blocks 2*e* to the base plate 2*d*. The dimensions of the bolts and springs as well as the tightness are adjusted such that a space is maintained between the suspension blocks 2*e* and the base plate 2*d*. Depending on the force transmitted to the springs of the suspension blocks 2*e*, in particular depending on the weight of the panel, the springs can be compressed without the suspension blocks 2*e* coming into contact with the base plate 2*d*. The desired suspension effect is thus ensured. Beyond an upper limit load value, the compression of the springs is such that the suspension blocks 2*e* are brought into contact with the base plate 2*d*.

Figure 3:
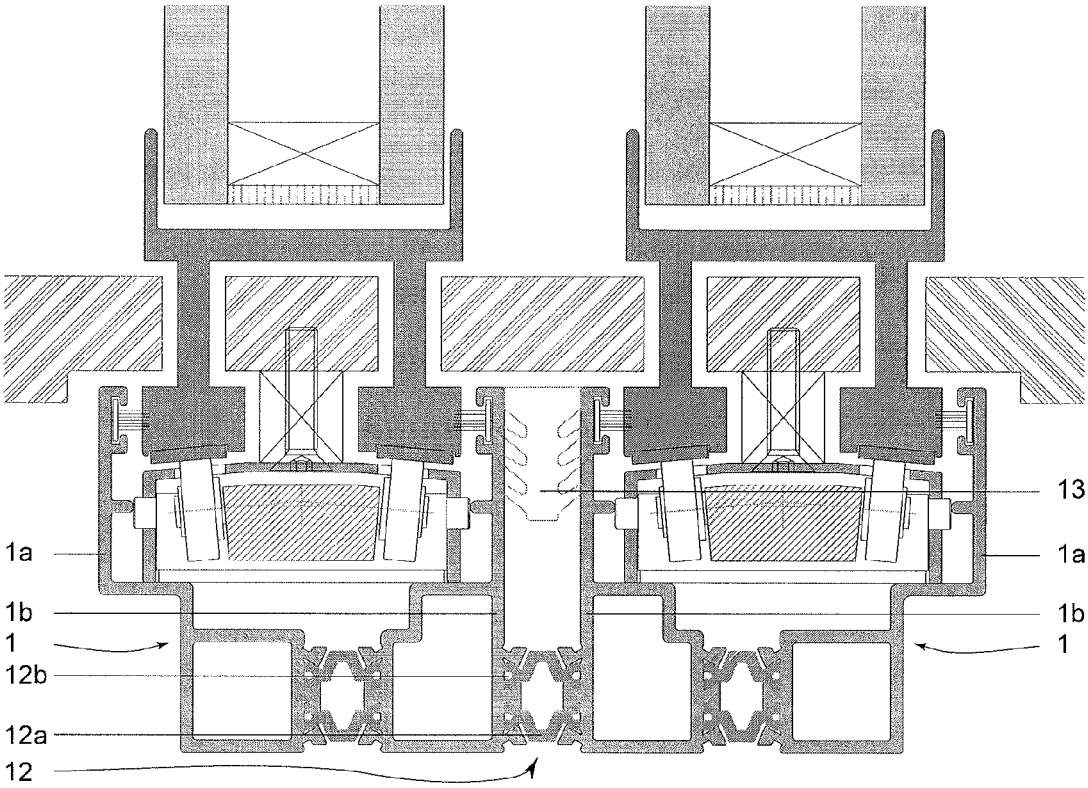
FIG. 3 is a cross-sectional view in a vertical plane of the lower part of a framing with two side-by-side frames in accordance with the invention, the two frames being in accordance with the first embodiment of the invention.

FIG. 3 is a vertical cross-section of the lower part of a framing with two side-by-side frames. The two fixed frames 1 conform to the first embodiment of the invention shown in FIG. 1 apart from the fact that the longitudinal profiled parts 1*a* and 1*b* of each respective frame are positioned so that two longitudinal profiled parts 1*b* are adjacent and thus constitute the inner longitudinal profiled parts of the framing, the longitudinal profiled parts 1*a* constituting the outer longitudinal profiled parts of the framing. Each of these fixed frames 1 contains the same elements as in FIG. 1 which means that it is not necessary to list them again. The two fixed frames 1 are held fixedly attached to each other with the help of connection means 12. These are similar to the connection means 10 holding the profiled parts 1*a* and 1*b* of each fixed frame 1 in a fixedly attached manner. The connection means 12 comprise at least one connecting strip 12*a* engaged in at least one slot 12*b* of the lateral edges of the longitudinal profiled parts 1*b*. The connection means 12 preferably comprise two connecting strips 12*a* each engaged in a different slot 12*b*. In order to perfect the thermal insulation, a heat seal 13 is positioned between the longitudinal profiled parts 1*b* of the side-by-side fixed frames 1.

Figure 4:
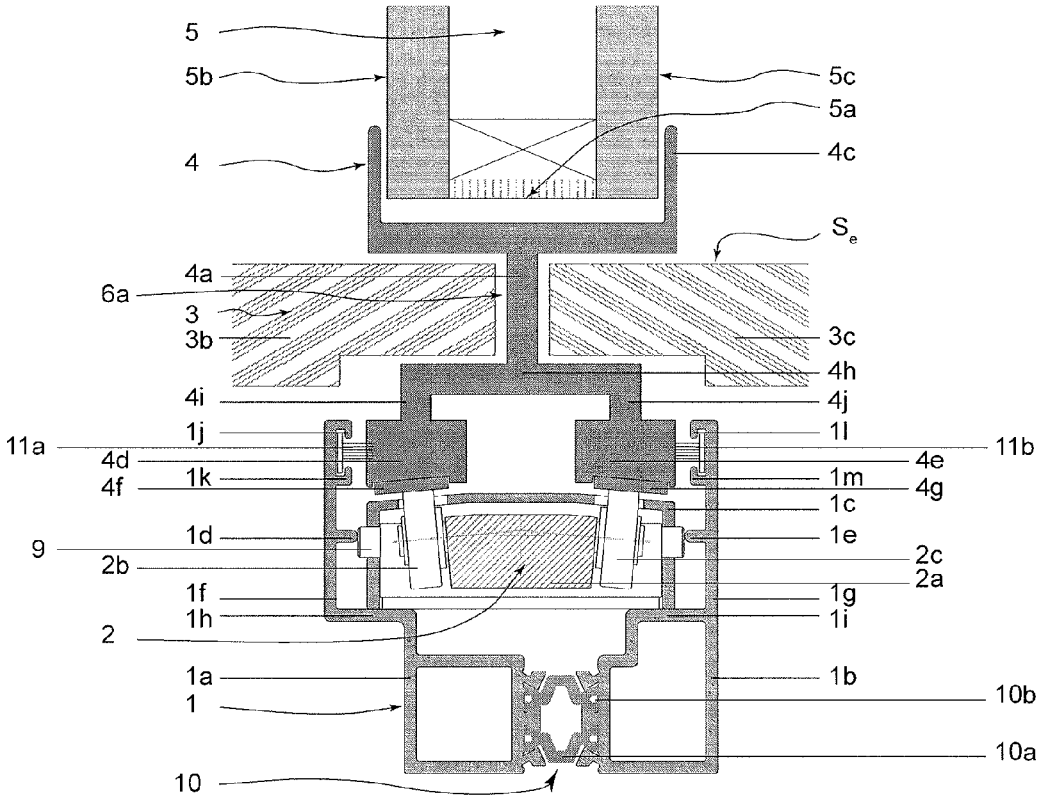
FIG. 4 is a cross-sectional view in a vertical plane of the lower part of a framing in accordance with the invention in a second embodiment.

FIG. 4 is a cross-sectional view on a vertical plane of the lower part of a framing in accordance with the invention in a second embodiment. The framing arranged to hold a panel 5, in this case formed by a double glazing unit, comprises an intermediate element 4, a fixed frame 1 and displacement means 2 associated with the fixed frame 1 permitting displacement of the panel 5 along the fixed frame 1. The main difference with respect to the first embodiment of the invention is found in the intermediate element 4. The intermediate element 4 comprises a profile 4*c* intended to be fixed to the panel 5, a main longitudinal wing 4*a* connected at one of its ends to the profile 4*c* and at the other end to a transverse wing 4*h* to which two longitudinal pads 4*d* and 4*e* are connected with the help of two secondary longitudinal wings 4*i* and 4*j*. The two longitudinal pads 4*d* and 4*e* are respectively provided with support strips 4*f* and 4*g*. The features of the profile 4*c* of the first embodiment as well as the features of the connection means between the profile 4*c* and the panel 5 also apply to this second embodiment. With a view to this device, the opening 3 comprises a through slot 6*a*. The through slot 6*a* is of a width less than 15 mm, preferably equal to 10 mm, while its cross-section is preferably rectangular. The main longitudinal wing 4*a* passes through the through slot 6*a* so that the profile 4*c* is fully positioned outside the opening 3, i.e. above the outer surface $S_e$ of the opening 3 for the lower part of the framing or below the outer surface $S_e$ of the opening 3 for the upper part of the framing. The main longitudinal wing 4*a* is preferably transversely centered in the through slot 6*a* and the width of the longitudinal wing 4*a* is such that the transverse distance between this and the opening 3 is less than 5 mm. With the help of the longitudinal pads 4*d* and 4*e* and of the support strips 4*f* and 4*g* disposed longitudinally, the intermediate element 4 cooperates with the displacement means 2 associated with the fixed frame 1 in the same way as in the first embodiment of the invention shown in FIGS. 1 to 3. This cooperation permits longitudinal displacement of the panel 5 along the fixed frame 1.

Owing to the framing being configured in this way, the panel 5 is disposed to slide longitudinally, i.e. in the plane perpendicular to the plane of FIG. 4, in the fixed frame 1. In the open position, the framing does not disclose any element protruding to the outside of the opening 3, the various constituent elements of the fixed frame being positioned entirely within this opening, i.e. below the surface $S_e$ of the opening 3 for the lower part of the framing and above the outer surface $S_e$ of the opening 3 for the upper part of the framing. Both from an aesthetic and a functional point of view, the said disadvantages of the traditional framing are avoided.

With respect to the first embodiment of the invention shown in FIGS. 1 to 3, the second embodiment shown in FIG. 4 offers the advantage of comprising only a single through slot in the opening, whereas the first embodiment requires two such slots. The use of the invention according to the second embodiment is particularly advantageous for an application where the panel is relatively light. Indeed, the intermediate element 4 comprising only a single main longitudinal wing 4*a*, the forces and stresses linked to the weight of the panel are entirely taken up by this longitudinal wing 4*a*. Beyond a certain limit weight for the panel, the first embodiment of the invention is preferred since the forces and stresses linked to the weight of the panel are taken up by the two main longitudinal wings 4*a* and 4*b*.

The Applicant presents below the description of a variation of the second embodiment of the invention. With respect to the second embodiment described above and shown in FIG. 4, the main differences are found in the intermediate element and the displacement means. The intermediate element, comprising a profile intended to be fixed to the panel and a main longitudinal wing connected at one of its ends to the said profile, is provided with a single longitudinal pad connected to the other end of the main longitudinal wing. The main longitudinal wing passes through a through slot so that the said profile is entirely positioned outside the opening. With the help of the longitudinal pad provided with a support strip disposed longitudinally, the intermediate element cooperates with displacement means associated with the fixed frame. These displacement means are described in the European patent application EP 2 221 440 A1. They comprise bearing slide support units. These units comprise an inverted U-shaped rail straddling two seats of the longitudinal profiled parts forming the fixed frame. Furthermore, the bearing slide support units comprise a shaft transversely passing through the inverted U-shaped rail and carrying a ball bearing. The intermediate element rests on the ball bearing via the support strip and the longitudinal pad. The bearing slide support units are placed at intervals along the fixed frame. The cooperation of the intermediate element with the displacement means permits the longitudinal displacement of the panel along the fixed frame. The longitudinal profiled parts forming the fixed frame comprise bosses intended to centre the displacement means in the fixed frame.

In the open position, the framing thus configured does not disclose any element protruding to the outside of the opening, the various constituent elements of the fixed frame being positioned entirely within this opening. From both an aesthetic and a functional point of view, the said disadvantages of the traditional framing are avoided.

The bearing slide support units can advantageously comprise two ball bearings mounted on a single shaft so that two longitudinal pads of an intermediate element can cooperate with the displacement means. A device of this type can be used in the first embodiment of the invention.

The invention claimed is:

1. A semi-hidden framing assembly for panels for windows, comprising openings within ceilings and floors along which the framing assembly slides at least one panel for windows, said framing assembly having a fixed frame with means for sliding panels for windows and having an intermediate element with at least one longitudinal wing and that is adapted to cooperate with the means for sliding panels for windows to permit the sliding of the panels for windows along the length of the fixed frame, said openings being through slots through a floor and a ceiling along the length of said fixed frame and through which said longitudinal wing passes, said openings being further defined by an upper surface that is aligned with a floor and with a lower surface that is aligned with a ceiling, and wherein the said fixed frame is positioned entirely above a ceiling and below a floor so that the fixed frame is not visible through the openings when a panel of windows slides along the length of the fixed frame, wherein said openings are at least two through slots through said floor and at least two through slots through said ceiling, said through slots through said floor and said through slots though said ceiling defining each two lateral opening elements and at least one intermediate opening element disposed between said lateral opening elements, wherein said intermediate element comprises at least two longitudinal wings, and wherein said longitudinal wings pass through said through slots and define at least one longitudinal channel in said intermediate element so that said intermediate opening element is engaged in said longitudinal channel.

2. A semi-hidden framing assembly according to claim 1, wherein the means for sliding panels for windows comprise bearing slide support units each comprising at least one ball bearing cooperating with said at least one longitudinal wing.

3. A semi-hidden framing assembly according to claim 2, wherein the means for sliding panels for windows comprise bearing slide support units each comprising at least two ball bearings cooperating with said at least one longitudinal wing and wherein the said ball bearings are mounted on fixed axes inclined in opposite directions so as to ensure self-centering of the at least one panel for windows as it slides.

4. A semi-hidden framing assembly according to claim 3, wherein the means for sliding panels for windows are fixedly attached to a covering profiled part by transverse pins dimensioned so as to be wedged between inner longitudinal ribs of each profiled part forming the fixed frame.

5. A semi-hidden framing assembly according to claim 1, wherein said intermediate element comprises at least two longitudinal pads each connected to one of the ends of said at least two longitudinal wings and intended to cooperate with said means for sliding panels.

6. A semi-hidden framing assembly according to claim 1, wherein said fixed frame comprises at least one covering profiled part provided with connection means for said intermediate opening element.

7. A semi-hidden framing assembly according to claim 6, wherein said covering profiled part is a U-shaped profile placed on two seats of two profiled parts forming said fixed frame.

8. A semi-hidden framing assembly according to claim 6, wherein said connection means comprise at least one bolt and at least one strut placed between said covering profiled part and said intermediate opening element.

9. Framing-opening assembly according to claim 1, wherein said at least one intermediate opening element is aligned with said lateral opening elements.

10. A semi-hidden framing assembly according to claim 1, wherein said intermediate element comprises at least one longitudinal pad connected to one of the ends of said at least one longitudinal wing and intended to cooperate with said means for sliding panels.

11. A semi-hidden framing assembly according to claim 10, wherein said at least one longitudinal pad is provided with a support strip disposed longitudinally and intended to cooperate with said means for sliding panels for windows.

12. A semi-hidden framing assembly according to claim 1, wherein said intermediate element comprises at least two longitudinal pads connected to one of the ends of said at least one longitudinal wing and intended to cooperate with said means for sliding panels.

13. A semi-hidden framing assembly according to claim 12, wherein said longitudinal wing is connected at one of its ends to a transverse wing on which at least two longitudinal pads are connected and intended to cooperate with said means for sliding panels for windows.

* * * * *